US010851318B2

(12) United States Patent
Ramesh et al.

(10) Patent No.: US 10,851,318 B2
(45) Date of Patent: Dec. 1, 2020

(54) DESCALING AND ANTI FOULING COMPOSITION

(71) Applicant: HINDUSTAN PETROLEUM CORPORATION LTD, Mumbai (IN)

(72) Inventors: Kanaparthi Ramesh, Bangalore (IN); Raman Ravishankar, Bangalore (IN); Chinthalapati Siva Kesava Raju, Bangalore (IN); Madala Sairamu, Bangalore (IN); Priyanka Saha, Bangalore (IN); Cheerladinne Venkateswarlu, Bangalore (IN); Peddy Venkat Chalapathi Rao, Bangalore (IN); Nettem Venkateswarlu Choudary, Bangalore (IN)

(73) Assignee: HINDUSTAN PETROLEUM CORPORATION LTD, Mumbai (IN)

( * ) Notice: Subject to any disclaimer, the term of this patent is extended or adjusted under 35 U.S.C. 154(b) by 60 days.

(21) Appl. No.: 15/777,421

(22) PCT Filed: Nov. 18, 2016

(86) PCT No.: PCT/IN2016/050412

§ 371 (c)(1),
(2) Date: May 18, 2018

(87) PCT Pub. No.: WO2017/085748

PCT Pub. Date: May 26, 2017

(65) Prior Publication Data

US 2018/0327678 A1 Nov. 15, 2018

(30) Foreign Application Priority Data

Nov. 20, 2015 (IN) ..... 4378/MUM/2015

(51) Int. Cl.
*C10G 75/04* (2006.01)
*C10G 9/16* (2006.01)

(52) U.S. Cl.
CPC ..... *C10G 75/04* (2013.01); *C10G 9/16* (2013.01)

(58) Field of Classification Search
None
See application file for complete search history.

(56) References Cited

U.S. PATENT DOCUMENTS 1,568,324 A * 1/1926 Dehn ..... C06B 21/005 149/17
1,955,031 A * 4/1934 Steudemann ..... C01D 9/10 423/397

(Continued)

FOREIGN PATENT DOCUMENTS

JP 2003293185 A 10/2003
WO WO/2014/101268 * 7/2014 ..... C05C 3/005

OTHER PUBLICATIONS

International Search Report and Written Opinion from corresponding PCT/IN2016/050412 dated Mar. 3, 2017.

*Primary Examiner* — Joseph D Anthony
(74) *Attorney, Agent, or Firm* — Lando & Anastasi, LLP

(57) ABSTRACT

The disclosure relates to an anti fouling composition including a metallic component comprising of at least one alkali metal salt and a non-metallic component and method for preparation of anti fouling composition. The disclosure also relates to a process of reducing fouling in reactors or furnaces using said composition.

20 Claims, 3 Drawing Sheets

(56) References Cited

U.S. PATENT DOCUMENTS 2,021,927 A * 11/1935 Strathmeyer ..... C01D 9/18 71/59
2,092,054 A * 9/1937 De Rewal ..... C05C 1/02 71/30
2,157,260 A * 5/1939 Dessevre ..... C01D 9/10 423/397
3,473,983 A * 10/1969 Clay ..... C06B 47/14 149/41
3,595,609 A * 7/1971 Beckham ..... C01C 1/164 423/395
3,867,124 A * 2/1975 Church ..... C05C 1/02 71/1
4,141,766 A * 2/1979 Cameron ..... C06B 47/14 149/2
4,175,943 A * 11/1979 Jordaan ..... C05B 17/00 71/29
4,283,423 A * 8/1981 Watkins ..... C05B 7/00 426/517
4,401,490 A * 8/1983 Alexander ..... C06B 31/285 149/2
4,431,558 A * 2/1984 Wada ..... C09K 5/063 252/70
4,508,632 A * 4/1985 Takeda ..... C09K 5/063 126/400
4,778,671 A 10/1988 Wusirika
4,992,118 A * 2/1991 Peng ..... C06B 47/145 149/109.6
5,258,174 A 11/1993 Schebece
5,683,619 A * 11/1997 Ossian ..... C09K 3/18 106/13
5,841,826 A 11/1998 Rootham et al.
6,585,883 B1 7/2003 Kelemen et al.
7,556,742 B1 * 7/2009 Ghaemaghami Rad ..... C09K 3/18 106/13
7,879,254 B2 * 2/2011 Jung ..... C09K 3/185 106/13
8,057,707 B2 11/2011 Srinivas et al.
2010/0038289 A1 2/2010 Wang et al.
2010/0163461 A1 7/2010 Wright et al.
2010/0186471 A1 * 7/2010 Vriesema ..... C05B 7/00 71/28
2011/0120603 A1 * 5/2011 Perez Cordova ..... C06B 47/145 149/46
2011/0147275 A1 6/2011 Ng et al.
2011/0266499 A1 * 11/2011 Vidal Fernandez ..... B01D 53/1456 252/183.13
2012/0121728 A1 * 5/2012 Antebi ..... A01N 47/28 424/661
2013/0008830 A1 1/2013 Ng et al.
2013/0171779 A1 7/2013 Jeong et al.
2014/0360239 A1 * 12/2014 Kleine-Kleffmann .... C05C 9/00 71/28
2015/0329433 A1 * 11/2015 Lv ..... C05C 3/005 71/29

* cited by examiner

DESCALING AND ANTI FOULING COMPOSITION

CROSS-REFERENCE TO RELATED APPLICATIONS

This application is a U.S. National Phase Application under 35 U.S.C. § 371 of International Application No. PCT/IN2016/050412, filed Nov. 18, 2016, which claims priority to Indian Application No. 4378/MUM/2015, filed Nov. 20, 2015. Both of which are hereby incorporated by reference in its entirety for all purposes.

TECHNICAL FIELD

The subject matter described herein in general relates to an anti fouling composition including a metallic component comprising of at least one alkali metal salt and a non-metallic component. The subject matter also relates to a method for preparation of anti fouling composition. The subject matter also relates to a process of reducing fouling in reactors or furnaces using said composition.

BACKGROUND

Fouling, which frequently occurs in refinery furnace, is broadly defined as the accumulation of unwanted material on the inner wall of a processing unit. Fouling can severely compromise the thermal efficiency of heat exchangers. This is an immense problem in petroleum refinery which affects the operation of refinery equipment in addition to the additional energy costs.

Very limited literature is available concerning the development of chemical composition for scale removal in oil refinery furnace. U.S. Pat. No. 6,585,883 discloses a method for removing the coke deposits inside the furnace tube of reactor utilizing steam, and catalyst. U.S. Pat. No. 8,057,707 discloses a composition including (a) at least one of dimethyldisulfide and dimethyl sulfide; and (b) a free radical scavenger selected from alpha-methyl-styrene dimmer and terpinolene, to mitigate coke formation in steam cracking of hydrocarbons. US patent No. 2010/0038289 A1 relates to the development of metal sulfonate additives for fouling mitigation in petroleum refining process. US 2011/0147275 discloses the use of polyalkylene epoxy polyamine additives for fouling mitigation in hydrocarbon refining processes. US patent 20130008830 discloses polyalkylene carboxylic acid polyamine additives as anti fouling agents and the use of said agents in methods and systems for reducing fouling, including particulate-induced fouling, in a hydrocarbon refining process. U.S. Pat. No. 5,841,826 discloses a chelate agent or a non-corrosive chemical cleaning agent containing a carrier and/or intercalation agent for dislodging and dislocating scale, sludge, corrosion and other deposits from heat transfer equipment surfaces, such as boiler and heat exchanger surfaces in steam generation systems, which are in contact with aqueous systems. The non-corrosive chemical cleaning agent may be a lower alkyl amine, e.g., dimethylamine, lower hydroxyalkyl amine, e.g., ethanolamine and pentanolamine, or cyclic dimines, e.g., 1,10-phenanthroline, 2,9-dimethyl-1,10-phenanthroline, 2,2'-bipyrindine and 4,4'-bypyridine, or combinations thereof.

SUMMARY

The present disclosure relates to an anti-fouling composition including: (a) a metallic component comprising of at least one metal salt; and (b) a non-metallic component. The present disclosure relates to a method for preparation of an anti-fouling composition for mitigation of foulants in reactors, the method including the steps of: (a) contacting at least one non-metallic component and a metallic component with water to form a mixture; and (b) removing water from the mixture to obtain a composition. The present disclosure also relates to a process of reducing fouling in reactors or furnaces using the anti-fouling composition.

These and other features, aspects and advantages of the present subject matter will be better understood with reference to the following description and appended claims. This summary is provided to introduce a selection of concepts in a simplified form. This summary is not intended to identify key features or essential features of the claimed subject matter, nor is it intended to be used to limit the scope of the claimed subject matter.

BRIEF DESCRIPTION OF DRAWINGS

The detailed description is described with reference to the accompanying figures. In the figures, the left-most digit(s) of a reference number identifies the figure in which the reference number first appears. The same numbers are used throughout the drawings to reference like features and components.

DETAILED DESCRIPTION

Figure 1:
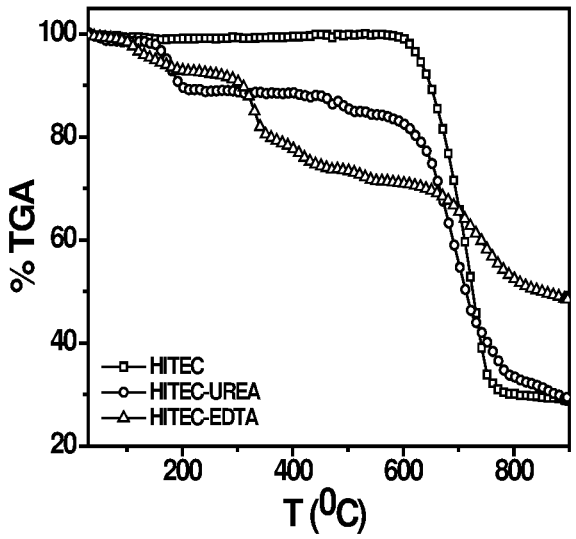
FIG. 1 illustrates TGA of HITEC salt (7% $NaNO_3$, 53% $KNO_3$, 40% $NaNO_2$), HITEC-UREA (10% Urea with 90% HITEC salt), and HITEC-EDTA (15% EDTA with 85% HITEC salt).

Those skilled in the art will be aware that the present disclosure is subject to variations and modifications other than those specifically described. It is to be understood that the present disclosure includes all such variations and modifications. The disclosure also includes all such steps, features, compositions and compounds referred to or indicated in this specification, individually or collectively and any and all combinations of any or more of such steps or features.

Definitions

For convenience, before further description of the present disclosure, certain terms employed in the specification, and examples are collected here. These definitions should be read in the light of the remainder of the disclosure and understood as by a person of skill in the art. The terms used herein have the meanings recognized and known to those of skill in the art, however, for convenience and completeness, particular terms and their meanings are set forth below.

The articles "a", "an" and "the" are used to refer to one or to more than one (i.e., to at least one) of the grammatical object of the article.

The terms "comprise" and "comprising" are used in the inclusive, open sense, meaning that additional elements may be included. Throughout this specification, unless the context requires otherwise the word "comprise", and variations, such as "comprises" and "comprising", will be understood to imply the inclusion of a stated element or step or group of element or steps but not the exclusion of any other element or step or group of element or steps.

The term "including" is used to mean "including but not limited to". "Including" and "including but not limited to" are used interchangeably.

The term "water of crystallization" or "water of hydration" refers to water that occurs inside the crystals.

Ratios, concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight ratio range of 50 to 95 should be interpreted to include not only the explicitly recited limits of 50 to 95, but also to include sub-ranges, such as 60 to 90, 55 to 80, and so forth, as well as individual amounts, including fractional amounts, within the specified ranges, such as 55.5, 75.1, and 85.9, for example.

Fouling can be observed in several parts of refinery such as heat exchangers, crude distillation unit, fluidized bed coking unit, visbreaking unit etc. Fouling material in general has low thermal conductivity which increases the resistance of heat transfer and increases the loss of energy. Fouling also decreases the surface area leading to increase in pressure drop in the system. Fouling in refinery furnace can result from several mechanisms such as thermal decomposition, chemical reaction, deposition of insoluble material, corrosion etc. One of the reasons for fouling is the formation of coke when oil is overheated. Another reason for the formation of scale is the precipitation of salt material present in the crude oil on the inner wall of furnace resulting in decrease in thermal conductivity. The solid coke deposits consist of carbon as major component with sulfur, vanadium, nickel, iron as minor component. Desalting is done to remove the salts before feeding in furnace. Otherwise the effect of the presence of salt in crude oil can be observed through the deposition of fouling material.

In refinery, distillation of crude oil is done from lower to higher temperature to get distillate fractions. The problem is that at enough high temperature hydrocarbon of crude may be degraded to coke which may accumulate inside the crude distillation unit. In case of crude distillation unit several metal oxides like vanadium, nickel are also deposited along with coke. This makes the removal of fouling material difficult. This results the decrease of efficiency of heat transfer; subsequently more energy is required for crude distillation. The furnace must be cleaned in order to get hassle free operating system. The present disclosure relates to an anti-fouling composition including: (a) a metallic component comprising of at least one metal salt; and (b) a non-metallic component. The anti-fouling composition can be used for removing coke and other scales deposits in oil refinery furnace tubes.

The composition of the present disclosure can be used for removal of foulant deposits in the interior walls of tube furnace used in refinery. Though the method of foulant removal is predominantly useful in crude distillation units, it can be applied to any refinery units in which coke and other foulant deposition occurs such as fluid cocker unit, fluid catalytic cracking units, thermal cracking furnace etc. The necessary thing required is the contact of steam containing composition with scaling materials on the tubes.

In one implementation, the anti-fouling composition includes: (a) a metallic component selected from the group of alkali metal salt, alkaline metal salt, transitional metal salt, salt of tin, and combinations thereof; and (b) a non-metallic component selected from the group of urea, oxalic acid, succinic acid, tartaric acid, EDTA, ammonium oxalate, ammonium nitrate, ammonium acetate, ammonium sulfate, sugar.

In one implementation, the anti-fouling composition includes: (a) a metallic component selected from the group of alkali metal salt, and combinations thereof; and (b) a non-metallic component selected from the group of urea, oxalic acid, succinic acid, tartaric acid, EDTA, ammonium oxalate, ammonium nitrate, ammonium acetate, ammonium sulfate, sugar, and combinations thereof.

In one implementation, the anti-fouling composition includes: (a) a metallic component comprising a combination of lithium, sodium, and potassium nitrate; and (b) a non-metallic component selected from the group of urea, oxalic acid, succinic acid, tartaric acid, EDTA, ammonium oxalate, ammonium nitrate, ammonium acetate, ammonium sulfate, sugar, and combinations thereof.

In one implementation, the anti-fouling composition includes: (a) a metallic component comprising a combination of sodium, and potassium nitrate; and (b) a non-metallic component selected from the group of urea, oxalic acid, succinic acid, tartaric acid, EDTA, ammonium oxalate, ammonium nitrate, ammonium acetate, ammonium sulfate, sugar, and combinations thereof.

In one implementation, the anti-fouling composition includes: (a) a metallic component comprising a combination of sodium and potassium nitrate, and sodium nitrite; and (b) a non-metallic component selected from the group of urea, oxalic acid, succinic acid, tartaric acid, EDTA, ammonium oxalate, ammonium nitrate, ammonium acetate, ammonium sulfate, sugar, and combinations thereof.

In one implementation, the anti-fouling composition includes: (a) a metallic component selected from the group of alkali metal salt, alkaline earth metal salt, and combinations thereof; and (b) a non-metallic component selected from the group of urea, oxalic acid, succinic acid, tartaric acid, EDTA, ammonium oxalate, ammonium nitrate, ammonium acetate, ammonium sulfate, sugar, and combinations thereof.

In one implementation, the anti-fouling composition includes: (a) a metallic component comprising a combination of sodium, potassium, and calcium nitrate, and combinations thereof; and (b) a non-metallic component selected from the group of urea, oxalic acid, succinic acid, tartaric acid, EDTA, ammonium oxalate, ammonium nitrate, ammonium acetate, ammonium sulfate, sugar, and combinations thereof.

In one implementation, the anti-fouling composition includes: (a) a metallic component comprising a combination of potassium, barium, calcium, magnesium, and lithium nitrate, and combinations thereof; and (b) a non-metallic component selected from the group of urea, oxalic acid, succinic acid, tartaric acid, EDTA, ammonium oxalate, ammonium nitrate, ammonium acetate, ammonium sulfate, sugar, and combinations thereof.

In one implementation, the anti-fouling composition includes: (a) a metallic component selected from the group of alkaline earth metal salt, and combinations thereof; and (b) a non-metallic component selected from the group of urea, oxalic acid, succinic acid, tartaric acid, EDTA, ammonium oxalate, ammonium nitrate, ammonium acetate, ammonium sulfate, sugar, and combinations thereof.

In one implementation, the anti-fouling composition includes: (a) a metallic component selected from the group of alkali metal salt, alkaline earth metal salts, transitional metal salts, and combinations thereof; and (b) a non-metallic component selected from the group of urea, oxalic acid, succinic acid, tartaric acid, EDTA, ammonium oxalate, ammonium nitrate, ammonium acetate, ammonium sulfate, sugar, and combinations thereof.

In one implementation, the anti-fouling composition includes: (a) a metallic component selected from the group of alkali metal salt, transitional metal salts, and combinations thereof; and (b) a non-metallic component selected from the group of urea, oxalic acid, succinic acid, tartaric acid, EDTA, ammonium oxalate, ammonium nitrate, ammonium acetate, ammonium sulfate, sugar, and combinations thereof.

In one implementation, the anti-fouling composition includes: (a) a metallic component selected from the group of alkaline earth metal salt, transitional metal salts, and combinations thereof; and (b) a non-metallic component selected from the group of urea, oxalic acid, succinic acid, tartaric acid, EDTA, ammonium oxalate, ammonium nitrate, ammonium acetate, ammonium sulfate, sugar.

In one implementation, the anti-fouling composition includes: (a) a metallic component selected from the group of transitional metal salts, and combinations thereof; and (b) a non-metallic component selected from the group of urea, oxalic acid, succinic acid, tartaric acid, EDTA, ammonium oxalate, ammonium nitrate, ammonium acetate, ammonium sulfate, sugar, and combinations thereof.

In one implementation, the anti-fouling composition includes: (a) a metallic component selected from the group of alkali metal salt, salt of tin, and combinations thereof; and (b) a non-metallic component selected from the group of urea, oxalic acid, succinic acid, tartaric acid, EDTA, ammonium oxalate, ammonium nitrate, ammonium acetate, ammonium sulfate, sugar, and combinations thereof.

In one implementation, the anti-fouling composition includes: (a) a metallic component selected from the group of alkaline earth metal salt, salt of tin, and combinations thereof; and (b) a non-metallic component selected from the group of urea, oxalic acid, succinic acid, tartaric acid, EDTA, ammonium oxalate, ammonium nitrate, ammonium acetate, ammonium sulfate, sugar, and combinations thereof.

In one implementation, the anti-fouling composition includes: (a) a metallic component selected from the group of transitional metal salt, salt of tin, and combinations thereof; and (b) a non-metallic component selected from the group of urea, oxalic acid, succinic acid, tartaric acid, EDTA, ammonium oxalate, ammonium nitrate, ammonium acetate, ammonium sulfate, sugar, and combinations thereof.

In one implementation, the anti-fouling composition includes: (a) a metallic component selected from the group of salt of tin, and combinations thereof; and (b) a non-metallic component selected from the group of urea, oxalic acid, succinic acid, tartaric acid, EDTA, ammonium oxalate, ammonium nitrate, ammonium acetate, ammonium sulfate, sugar, and combinations thereof.

In one implementation, the anti-fouling composition includes: (a) a metallic component selected from the group of alkali metal salt, alkaline metal salt, transitional metal salt, salt of tin, and combinations thereof; and (b) a non-metallic component comprising urea.

In one implementation, the anti-fouling composition includes: (a) a metallic component selected from the group of alkali metal salt, alkaline metal salt, transitional metal salt, salt of tin, and combinations thereof; and (b) a non-metallic component comprising a combination of urea and ammonium salt.

In one implementation, the anti-fouling composition includes: (a) a metallic component selected from the group of alkali metal salt, alkaline metal salt, transitional metal salt, salt of tin, and combinations thereof; and (b) a non-metallic component comprising EDTA.

In one implementation, the anti-fouling composition includes: (a) a metallic component selected from the group of alkali metal salt, alkaline metal salt, transitional metal salt, salt of tin, and combinations thereof; and (b) a non-metallic component comprising sugar.

In one implementation, the anti-fouling composition includes: (a) a metallic component selected from the group of alkali metal salt, alkaline metal salt, transitional metal salt, salt of tin, and combinations thereof; and (b) a non-metallic component comprising monosaccharide.

In one implementation, the anti-fouling composition includes: (a) a metallic component selected from the group of alkali metal salt, alkaline metal salt, transitional metal salt, salt of tin, and combinations thereof; and (b) a non-metallic component comprising mannose.

In one implementation, the anti-fouling composition includes: (a) a metallic component selected from the group of alkali metal salt, alkaline metal salt, transitional metal salt, salt of tin, and combinations thereof; and (b) a non-metallic component selected from the group of ammonium salts and combinations thereof.

In one implementation, the anti-fouling composition includes: (a) a metallic component selected from the group of alkali metal salt, alkaline metal salt, transitional metal salt, salt of tin, and combinations thereof; and (b) a non-metallic component selected from the group of ammonium oxalate, ammonium nitrate, ammonium acetate, ammonium sulfate, and combinations thereof.

In one implementation, the anti-fouling composition includes: (a) a metallic component selected from the group of alkali metal salt, alkaline metal salt, transitional metal salt, salt of tin, and combinations thereof; and (b) a non-metallic component comprising oxalic acid.

In one implementation, the anti-fouling composition includes: (a) a metallic component selected from the group of alkali metal salt, alkaline metal salt, transitional metal salt, salt of tin, and combinations thereof; and (b) a non-metallic component comprising succinic acid.

In one implementation, the anti-fouling composition includes: (a) a metallic component selected from the group of alkali metal salt, alkaline metal salt, transitional metal salt, salt of tin, and combinations thereof; and (b) a non-metallic component comprising tartaric acid.

In one implementation, the anti-fouling composition includes: (a) a metallic component selected from the group of alkali metal salt, alkaline metal salt, transitional metal salt, salt of tin, and combinations thereof; and (b) a non-metallic component selected from the group of urea, oxalic acid, succinic acid, tartaric acid, EDTA, ammonium oxalate, ammonium nitrate, ammonium acetate, ammonium sulfate, sugar, wherein the metallic component weight ratio in the composition is in the range of 50 to 95% and the non-metallic ratio in the composition is in the range of 5 to 50%.

In one implementation, the anti-fouling composition includes: (a) a metallic component selected from the group of alkali metal salt, alkaline metal salt, transitional metal salt, salt of tin, and combinations thereof; and (b) a non-metallic component selected from the group of urea, oxalic acid, succinic acid, tartaric acid, EDTA, ammonium oxalate, ammonium nitrate, ammonium acetate, ammonium sulfate, sugar, wherein the metallic component weight ratio in the composition is in the range of 60 to 90% and the non-metallic ratio in the composition is in the range of 40 to 10%.

In one implementation, the anti-fouling composition includes: (a) a metallic component selected from the group of alkali metal salt, alkaline metal salt, transitional metal salt, salt of tin, and combinations thereof; and (b) a non-metallic component selected from the group of urea, oxalic acid, succinic acid, tartaric acid, EDTA, ammonium oxalate, ammonium nitrate, ammonium acetate, ammonium sulfate, sugar, wherein the metallic component weight ratio in the composition is in the range of 60 to 90% and the non-metallic ratio in the composition is in the range of 40 to 10%, wherein the metallic component is a combination of sodium nitrate and potassium nitrate with a weight ratio in the range of 1:1 to 4:1.

In one implementation, the anti-fouling composition includes: (a) a metallic component selected from the group of alkali metal salt, alkaline metal salt, transitional metal salt, salt of tin, and combinations thereof; and (b) a non-metallic component selected from the group of urea, oxalic acid, succinic acid, tartaric acid, EDTA, ammonium oxalate, ammonium nitrate, ammonium acetate, ammonium sulfate, sugar, wherein the metallic component weight ratio in the composition is in the range of 80 to 90% and the non-metallic ratio in the composition is in the range of 20 to 10%, wherein the metallic component is a eutectic mixture of lithium, potassium, barium, magnesium, and calcium nitrate.

In one implementation, the anti-fouling composition includes: (a) a metallic component selected from the group of alkali metal salt, alkaline metal salt, transitional metal salt, salt of tin, and combinations thereof; and (b) a non-metallic component selected from the group of urea, oxalic acid, succinic acid, tartaric acid, EDTA, ammonium oxalate, ammonium nitrate, ammonium acetate, ammonium sulfate, sugar, wherein the metallic component weight ratio in the composition is in the range of 80 to 90% and the non-metallic ratio in the composition is in the range of 20 to 10%, wherein the metallic component is a eutectic mixture of sodium, potassium, and calcium nitrate.

In one implementation, the anti-fouling composition includes: (a) a metallic component selected from the group of alkali metal salt, alkaline metal salt, transitional metal salt, salt of tin, and combinations thereof; and (b) a non-metallic component comprising EDTA, wherein the metallic component weight ratio in the composition is in the range of 80 to 90% and the non-metallic ratio in the composition is in the range of 20 to 10%, wherein the metallic component is a eutectic mixture of sodium, potassium, and calcium nitrate.

In one implementation, the anti-fouling composition includes: (a) a metallic component comprising of nitrate salt of Na and K; and (b) a non-metallic component comprising of a combination of urea, and ammonium oxalate, wherein the metallic component weight ratio in the composition is in the range of 80 to 90% and the non-metallic ratio in the composition is in the range of 20 to 10%.

In one implementation, the anti-fouling composition includes: (a) a metallic component comprising of nitrate salt of Na and K; and (b) a non-metallic component comprising of urea, wherein the metallic component weight ratio in the composition is in the range of 80 to 90% and the non-metallic ratio in the composition is in the range of 20 to 10%.

The disclosure also relates to foulant removal in the interior tube of several furnace of oil refinery used to heat different kinds of petroleum products. The anti-foulant composition of present disclosure can be applied to different furnaces or tubes available in oil refinery or elsewhere.

The method of foulant removal involves the introduction of descaling material in the furnace through aqueous solution at high temperature of reactor. The solution containing descaling material or the anti-fouling composition can be introduced through injection ports, nozzles etc. At high temperature of reactor, water molecules form steam vapour which thermally attacks the coke deposits leading to their decomposition to carbon monoxide and hydrogen. The gaseous products can be removed from the furnace by the flow of steam. The inorganic scale with metallic residue can not be removed simply by treating with steam flow. The anti-fouling composition gets easily decomposed to form small molecule which can coordinate to metal resulting in complexes which are easily removed by the flow of water at high temperature.

The process of foulant removal from reactors is an efficient way to remove the coke deposits inside the furnace in refinery. Coke deposits can be removed effectively in all areas of the furnace where steam with anti-fouling composition can be injected and contacted with the coke deposits. The foulant can be removed from any surfaces of the furnace unit utilizing the method described herein.

In one implementation, the method of foulant removal involves injecting water with anti-foulant composition into the furnace so that it can contact with the coke deposits at temperatures around 800 to 1200° C. High temperature is required to convert the coke to carbon monoxide and hydrogen. Carbon dioxide and water are also produced via combustion mechanism in presence of sufficient oxygen. The rate at which the gasification occurs will depend on the surface area of the scale and the nature of descaling material. The scale removal can be done at high pressure of steam and in presence of sufficient oxygen. The descaling can be done for every month depending on the level of coke deposited.

In one implementation, the anti-foulant composition can be dissolved in water to form a solution. In another implementation, the weight percentage of the anti-foulant composition with respect to the solution can be 1 to 10%. In yet another implementation, the weight percentage of the anti-foulant composition with respect to the solution can be 2 to 5%. The solution comprising anti-foulant composition can be sprayed over the reactor tubes at temperature above 600 to 1200° C. The composition can strongly react with deposits over the reactors thereby improving the heat exchange capacity.

In one implementation, the foulant deposits can be removed from the interior walls of tube furnace used in refinery. Though the method is predominantly useful in crude distillation units, it can be applied to any refinery units in which coke and other foulant deposition occurs such as Fluid Cocker Unit, Fluid Catalytic Cracking Units, thermal cracking furnace etc. The necessary thing required is the contact of steam containing scale remover formulation with scaling materials on the tubes.

The disclosure also relates to a method for preparation of a composition for mitigation of foulants in reactors, the method comprising the steps of: contacting at least one non-metallic component and a metallic component with water to form a mixture; removing water from the mixture to obtain a composition.

EXAMPLES

The disclosure will now be illustrated with working examples, which is intended to illustrate the working of disclosure and not intended to take restrictively to imply any limitations on the scope of the present disclosure. Other examples are also possible which are within the scope of the present disclosure.

TGA-DSC was measured only using STA 449 Netzsch instrument. The measurement was done using a calibration file. Two alumina crucibles were required for the measurement. One is empty crucible and in another crucible, sample was kept. The heating was done at the rate of 10K/min and the weight loss is calculated. Relative to empty crucible the heat flow was calculated for the sample pan.

Example 1

In order to develop an efficient formulation for scale removal, the help of TGA has been taken. The formulation should be decomposed completely during the operating temperature (800° C.). A number of compositions have been made and their thermal properties are studied. The list of TGA data are given in Table 1. TGA analysis has been done taking 3-5 mg sample in presence of zero air (80 ml/minute) with heating rate 10° C./minute upto 800 to 900° C.

Example 2

The anti-fouling composition contains two or more water soluble salt of sodium, potassium, calcium, lithium, barium as metallic component part and urea, oxalic acid, succinic acid, tartaric acid, EDTA, ammonium salts as non-metallic component. 200 mg of compositions comprising metallic and non-metallic component were prepared by mixing certain percentage of inorganic salt with the organic compound (specific weight ratios provided in Table 1) in water (5 mL) to make a homogeneous solution. Water was removed using rotavapor under 50° C. of water bath temperature and vacuum pump pressure was reduced to 10-20 mbar. The complete drying process was continued for 1 hour for each composition. Among several compositions, SM4-EDTA and SS-URAMOX show best result (Table 1). Negligible amount of residue remained after their TGA analysis. This can be explained as the formation of gaseous molecule from the corresponding composition.

Example 3

Thermal stability of scale material obtained from Refinery CDU Heater has also been tested using muffle furnace. 1 g of scale material has been taken to alumina crucible and kept in muffle furnace for about 6 hour at 800° C. After baking about 33% weight loss are observed. It indicates that some foreign material is required to make its decomposition complete at this temperature.

Example 4

Thermal stability of non-metallic component were determined using muffle furnace. 1 g each of ammonium sulphate, ammonium oxalate, urea, EDTA, oxalic acid were taken separately in alumina crucible and kept at 600° C. for 4 h. In each case, almost complete decomposition was observed. Another experiment was carried out by mixing equal amount of scale (0.5 g) and organic mixture (0.5 g, 1:1:1 mixture of urea, ammonium sulphate, ammonium oxalate) and then kept the mixture at muffle furnace for 6 hr at 800° C. The observed weight loss is 67%.

Example 5

In refinery the descaling experiment is done by dissolving the commercial descaling material in water and then injecting this solution to the furnace. Water at high temperature of furnace reacts with coke forming carbon monoxide and hydrogen as gaseous product. Thus only coke can be removed in this way but metallic impurity can not be removed simply by treating with water. In order to remove both metallic and coke impurity, several compositions have been prepared. Equal amount of scale and SS (80%)-Organic mixture (20%) was taken and kept at 800° C. for 6 hour. About 42% weight loss has been observed.

TABLE 1

Results of TGA data

| Entry | Sample name | Composition | Condition | Remaining Residue (%) |
|---|---|---|---|---|
| 1 | Sample B | Scale material | air | 73.87 |
| 2 | $NaNO_3$ | Pure | air | 27.88 |
| 3 | $KNO_3$ | Pure | $N_2$ | 49.05 |
| 4 | $Na_2SO_4$ | Pure | air | No decomposition |
| 5 | $CuSO_4 \cdot 5H_2O$ | Pure | air | 46.06 |
| 6 | Urea | pure urea | $N_2$ | 1.04 |
| 7 | EDTA | Pure EDTA | $N_2$ | 4.97 |
| 8 | HITEC Salt | 7% $NaNO_3$, 53% $KNO_3$, 40% $NaNO_2$ | air | 26.97 |
| 9 | HITEC-Urea | 10% Urea with 90% HITEC salt | $N_2$ | 29.29 |
| 10 | HITEC-EDTA | 15% EDTA with 90% HITEC salt | air | 48.45 |
| 11 | $(NH_4)_2SO_4$ | Pure | air | 14.21 |
| 12 | $(NH_4)_2OX$ | Pure | air | 7.22 |
| 13 | SM1 | 50% $KNO_3$, 20% $BaNO_3$, 15% $CaNO_3$, 10% $MgNO_3$, 5% $NaNO_3$ | air | 23.95 |
| 14 | SM1-M1 | 15% Mannose and 85% SM1 | air | 36.12 |
| 15 | SM1-$NH_4OH$ | — | air | 55.88 |
| 16 | SM2-UREA(10%) | SM2: 30% $KNO_3$, 35% $BaNO_3$, 13% $CaNO_3$, 12% $MgNO_3$, 10% $LiNO_3$ SM2-Urea(10%): SM2(90%) and Urea 10% | air | 34.71 |
| 17 | SM3-UREA(10%) | SM3: 49% $KNO_3$, 30% $CaNO_3$, 21% $NaNO_3$ SM3-UREA(10%): SM3(90%) and urea 10% | $N_2$ | 23.54 |
| 18 | SM4 | 58% $KNO_3$, 11% $CaNO_3$, 31% $NaNO_3$ | $N_2$ | 21.67 |
| 19 | SM4-UREA | 90% SM4 and 10% urea | $N_2$ | 15.85 |

TABLE 1-continued

Results of TGA data

| Entry | Sample name | Composition | Condition | Remaining Residue (%) |
|---|---|---|---|---|
| 20 | SM4-EDTA | 80% SM4 and 20% EDTA | $N_2$ | 5.51 |
| 21 | SM5-UREA(20%) | SM5: 53% $KNO_3$, 7% $LiNO_3$, 40% $NaNO_2$ SM5-UREA(20%): 80% SM5 and 20% urea | $N_2$ | 27.64 |
| 22 | OM1 | 40% urea, 40% ammonium oxalate, 20% ammonium sulfate | air | 14.26 |
| 23 | OM1-4% $Na_2SO_4$ | — | air | 15.12 |
| 24 | SS | 60% $NaNO_3$, 40% $KNO_3$ | air | 26.03 |
| 26 | SS-urea(20%) | 20% urea with 80% SS | air | 16.96 |
| 27 | SS-AMOX(20%) | 20% ammonium oxalate with 80% SS | air | 18.83 |
| 28 | SS-AMS(20%) | 20% ammonium sulfate with 80% SS | air | 41.43 |
| 29 | SS-URAMOX | 10% ammonium oxalate, 10% urea, 80% SS | air | 8.44 |
| 30 | SS-URAMOXAMS | 20% (1:1:1) mixture of ammonium oxalate, ammonium sulfate and urea with 80% SS | air | 28.71 |

FIG. 1 illustrates TGA of HITEC, HITEC-UREA and HITEC-EDTA under zero air up to 900° C. HITEC salt is a composition made from 7% $NaNO_3$, 53% $KNO_3$ and 40% $NaNO_2$. HITEC-UREA is made from 90% HITEC salt and 10% UREA. On the other hand HITEC-EDTA is made from 85% HITEC salt and 15% EDTA. About 26.97% residue remained in HITEC salt while 29.29% and 48.45% residue remained for HITEC-UREA and HITEC-EDTA after the experiment.

Figure 2:
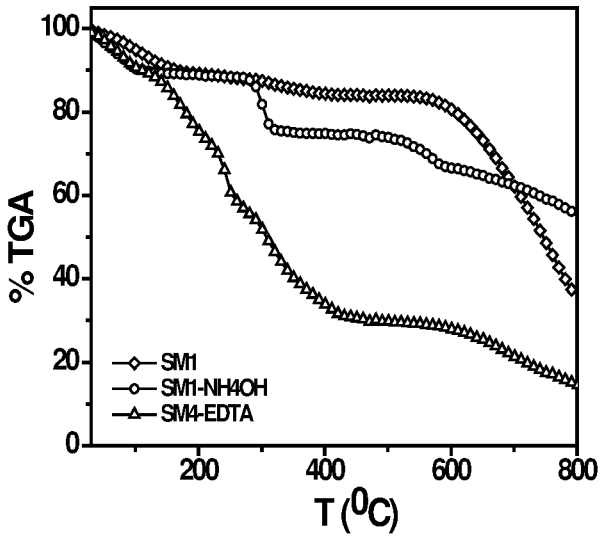
FIG. 2 illustrates TGA of SM1 (50% $KNO_3$, 20% $BaNO_3$, 15% $CaNO_3$, 10% $MgNO_3$, 5% $NaNO_3$), SM1-$NH_4OH$ (prepared using 500 mg SM1 and NH4OH to get pH around 11), and SM4-EDTA (80% SM4 and 20% EDTA; SM4: 58% $KNO_3$, 11% $CaNO_3$, 31% $NaNO_3$).

FIG. 2 illustrates TGA of SM1, SM1-$NH_4OH$, and SM4-EDTA under zero air up to 900° C. SM1 is a composition made from 50% $KNO_3$, 20% $BaNO_3$, 15% $CaNO_3$, 10% $MgNO_3$, 5% $NaNO_3$. After running TGA under the mentioned condition, about 23.95% residue remained. SM1-$NH_4OH$ is a composition made from SM1 and $NH_4OH$. SM1 was dissolved in water and $NH_4OH$ was added to it to get a pH of 11. Under this condition white precipitate came. This is treated as SM1-$NH_4OH$. SM4-EDTA is made from 80% SM4 and 20% EDTA and this mixture surprisingly gave 5.51% residue after the analysis upto 900° C.

Figure 3:
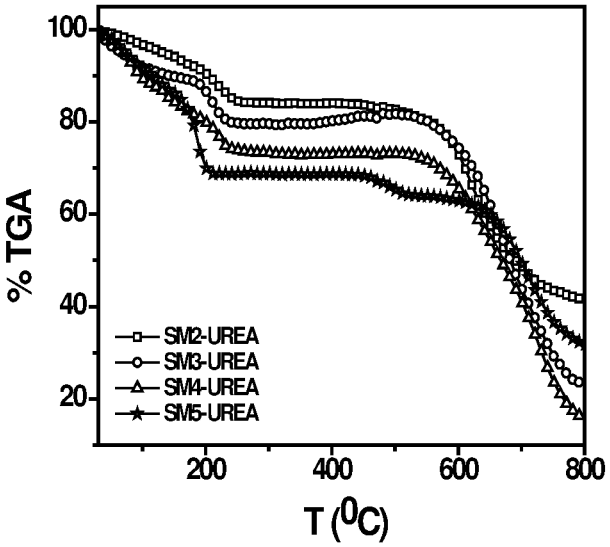
FIG. 3 illustrates TGA of SM2-UREA (SM2(90%) and UREA 10%; SM2: 30% $KNO_3$, 35% $BaNO_3$, 13% $CaNO_3$, 12% $MgNO_3$, 10% $LiNO_3$), SM3-UREA (SM3(90%) and UREA 10%; SM3: 49% $KNO_3$, 30% $CaNO_3$, 21% $NaNO_3$), SM4-UREA (90% SM4 and 10% UREA; SM4: 58% $KNO_3$, 11% $CaNO_3$, 31% $NaNO_3$), and SM5-UREA (80% SM5 and 20% urea; SM5: 53% $KNO_3$, 7% $LiNO_3$, 40% $NaNO_2$).

FIG. 3 illustrates TGA of SM2-UREA, SM3-UREA, SM4-UREA, and SM5-UREA under zero air up to 900° C. SM2 is a composite mixture of 30% $KNO_3$, 35% $BaNO_3$, 13% $CaNO_3$, 12% $MgNO_3$, 10% $LiNO_3$. SM2-UREA is composed of 10% urea and 90% SM2. It showed 34.71% residue after TGA analysis. SM3 salt mixture is made from 49% $KNO_3$, 30% $CaNO_3$, 21% $NaNO_3$. SM3-UREA is made from 90% SM3 and 10% UREA. It gave 23.54% residue after thermal analysis. SM4 salt mixture is made from 58% $KNO_3$, 11% $CaNO_3$, 31% $NaNO_3$. SM4-UREA is made from 90% SM4 and 10% Urea and this mixture produced 15.85% residue. SM5 is a mixture of 53% $KNO_3$, 7% $LiNO_3$, 40% $NaNO_2$. SM5-UREA (20%) is made of 80% SM5 and 20% urea which produced 27.64% residue after the experiment. All of this TGA analysis has been done upto 800° C.-900° C.

Figure 4:
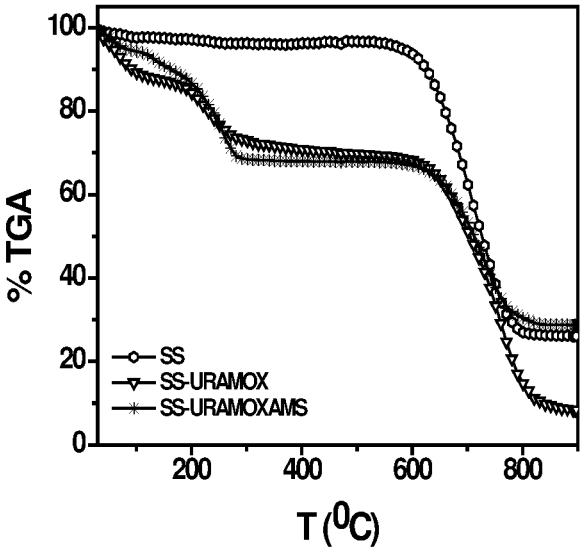
FIG. 4 illustrates TGA of SS (Solar Salt: 60% $NaNO_3$, 40% $KNO_3$), SS-URAMOX (10% ammonium oxalate, 10% urea, 80% SS), and SS-URAMOXAMS (20% (1:1:1) mixture of ammonium oxalate, ammonium sulfate and urea with 80% SS).

FIG. 4 illustrates TGA of SS, SS-URAMOX, and SS-URAMOXAMS under zero air up to 900° C. Solar salt (SS) is a salt mixture of 60% $NaNO_3$, 40% $KNO_3$. SS-URAMOX is made from 10% ammonium oxalate, 10% urea, 80% SS. The composition surprisingly exhibited 8.44% residue after TGA analysis. SS-URAMOXAMS is made from 20% (1:1:1) mixture of ammonium oxalate, ammonium sulfate and urea with 80% SS. After TGA analysis of this composition upto 900° C. in air 28.71% residue remained.

Figure 5:
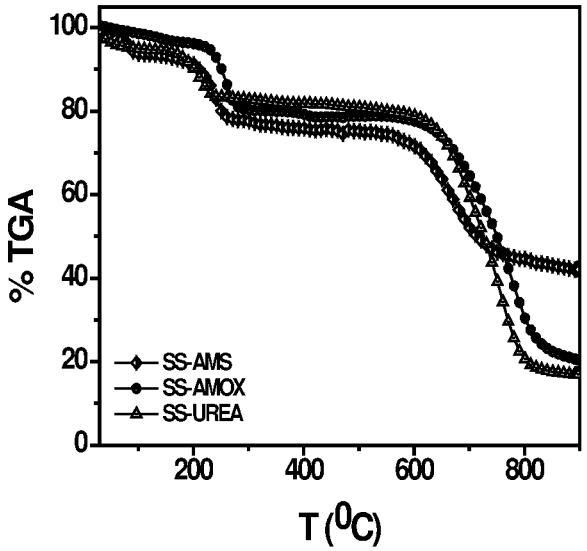
FIG. 5 illustrates TGA of SS-AMS (20% ammonium sulfate and 80% SS), SS-AMOX (20% ammonium oxalate and 80% SS), and SS-UREA (15% urea with 85% SS).

FIG. 5 illustrates TGA of SS-UREA SS-AMX, and SS-AMOX under zero air up to 900° C. SS-UREA is made of 20% urea with 80% SS and it showed 16.96% residue. Similarly SS-AMOX is made of 20% ammonium oxalate with 80% SS and this composition gave 18.83% residue under same condition. SS-AMS is made of 20% ammonium sulfate with 80% SS and showed 41.43% residue.

Figure 6:
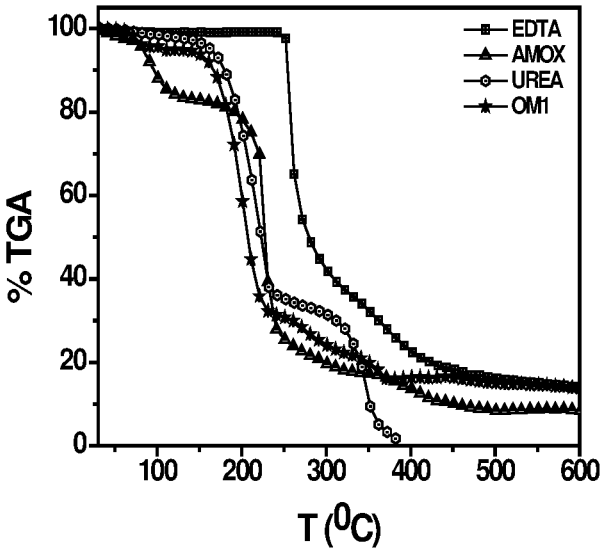
FIG. 6 illustrates TGA of EDTA, AMOX, UREA, and OM1 (40% urea, 40% ammonium oxalate, 20% ammonium sulfate).

FIG. 6 illustrates TGA of EDTA, AMOX, UREA, and OM1 under zero air up to 900° C.

For Urea almost complete decomposition was observed (1% residue). In case of EDTA and AMOX 4.97% and 7.22% residue after TGA analysis upto 800° C. Organic mixture (OM1) is made from 40% urea, 40% ammonium oxalate, 20% ammonium sulfate and showed 14.26% residue after analysis.

Although the subject matter has been described in considerable detail with reference to certain examples and implementations thereof, other implementations are possible. As such, the spirit and scope of the appended claims should not be limited to the description of the preferred examples and implementations contained therein.

ADVANTAGES

The composition of the present disclosure can be effective used as an anti-fouling composition or a de-salting material or de-scaling material.

We claim:

1. An anti-fouling composition comprising:

a metallic component selected from the group of alkali metal salt, alkaline earth metal salt, transitional metal salt, salt of tin, and combinations thereof; and a non-metallic component comprising urea and ammonium oxalate, in effective amounts for anti-fouling, wherein the metallic component weight ratio is in the range of 50 to 95% with respect to the composition and the non-metallic component weight ratio is in the range of 5 to 50% with respect to the composition.

2. The composition as claimed in claim 1, wherein the metallic component comprises the alkali metal salt.

3. The composition as claimed in claim 1, wherein the metallic component comprises the alkaline earth metal salt.

4. The composition as claimed in claim 1, wherein the metallic component comprises the transitional metal salt.

5. The composition as claimed in claim 1, wherein the metallic component comprises the salt of tin.

6. The composition as claimed in claim 1, having effective amounts of the metallic component and the non-metallic components for foulant removal.

7. A method for preparation of a composition for mitigation of foulants in reactors, the method comprising:

contacting a non-metallic component selected from the group of urea, oxalic acid, succinic acid, tartaric acid, EDTA, ammonium oxalate, ammonium acetate, ammonium sulfate, sugar, and combinations thereof, and a metallic component comprising a nitrate salt of sodium and a nitrate salt of potassium at a weight ratio of 1:1 to 4:1 with water in effective amounts for anti-fouling to form a mixture, wherein the metallic component is in a weight ratio of 60 to 90% and the non-metallic component is in a weight ratio of 10 to 40%; and removing the water from the mixture to obtain the composition.

8. The method as claimed in claim 7, wherein the non-metallic component is urea.

9. The method as claimed in claim 7, wherein the non-metallic component is EDTA.

10. The composition as claimed in claim 2, wherein the alkali metal salt comprises a nitrate salt of sodium and a nitrate salt of potassium.

11. An anti-fouling composition comprising:

a metallic component comprising a nitrate salt of sodium and a nitrate salt of potassium at a weight ratio of 1:1 to 4:1; and a non-metallic component selected from the group of urea, oxalic acid, succinic acid, tartaric acid, EDTA, ammonium oxalate, ammonium nitrate, ammonium acetate, ammonium sulfate, sugar, and combinations thereof, in effective amounts for anti-fouling, wherein the metallic component weight ratio is in the range of 60 to 90% with respect to the composition and the non-metallic component weight ratio is in the range of 10 to 40% with respect to the composition.

12. The composition as claimed in claim 11, wherein the non-metallic component is urea.

13. The composition as claimed in claim 12, wherein the non-metallic component is a combination of urea and the ammonium salt.

14. The composition as claimed in claim 11, wherein the non-metallic component is EDTA.

15. The composition as claimed in claim 11, wherein the non-metallic component is sugar.

16. The composition as claimed in claim 11, wherein the non-metallic component comprises an ammonium salt.

17. The composition as claimed in claim 11, wherein the non-metallic component is oxalic acid.

18. The composition as claimed in claim 11, wherein the non-metallic component is tartaric acid.

19. The composition as claimed in claim 11, having effective amounts of the metallic component and the non-metallic components for foulant removal.

20. The composition as claimed in claim 11, wherein the non-metallic component comprises urea and ammonium oxalate.

* * * * *